US006876968B2

(12) United States Patent
Veprek

(10) Patent No.: US 6,876,968 B2
(45) Date of Patent: Apr. 5, 2005

(54) RUN TIME SYNTHESIZER ADAPTATION TO IMPROVE INTELLIGIBILITY OF SYNTHESIZED SPEECH

(75) Inventor: Peter Veprek, Santa Barbara, CA (US)

(73) Assignee: Matsushita Electric Industrial Co., Ltd., Osaka (JP)

( * ) Notice: Subject to any disclaimer, the term of this patent is extended or adjusted under 35 U.S.C. 154(b) by 670 days.

(21) Appl. No.: 09/800,925

(22) Filed: Mar. 8, 2001

(65) Prior Publication Data

US 2002/0128838 A1 Sep. 12, 2002

(51) Int. Cl.[7] ..... G10L 13/00
(52) U.S. Cl. ..... 704/258; 704/260; 704/266
(58) Field of Search ..... 704/258, 260, 704/266, 205, 233, 268, 200, 270; 342/383; 715/501.1

(56) References Cited

U.S. PATENT DOCUMENTS 4,903,302 A * 2/1990 Graciotti et al. ..... 704/205
5,278,943 A * 1/1994 Gasper et al. ..... 704/200
5,751,906 A * 5/1998 Silverman ..... 704/260
5,818,389 A * 10/1998 Lazar ..... 342/383
5,970,446 A * 10/1999 Goldberg et al. ..... 704/233
6,035,273 A * 3/2000 Spies ..... 704/270
6,199,076 B1 * 3/2001 Logan et al. ..... 715/501.1
6,226,614 B1 * 5/2001 Mizuno et al. ..... 704/260
6,253,182 B1 * 6/2001 Acero ..... 704/268

* cited by examiner

*Primary Examiner*—David Ometz
*Assistant Examiner*—Huyen X. Vo
(74) *Attorney, Agent, or Firm*—Harness, Dickey & Pierce, PLC

(57) ABSTRACT

A method and system provide for run-time modification of synthesized speech. The method includes the step of generating synthesized speech based on textual input and a plurality of run-time control parameter values. Real-time data is generated based on an input signal, where the input signal characterizes an intelligibility of the speech with regard to a listener. The method further provides for modifying one or more of the run-time control parameter values based on the real-time data such that the intelligibility of the speech increases. Modifying the parameter values at run-time as opposed to during the design stages provides a level of adaptation unachievable through conventional approaches.

19 Claims, 6 Drawing Sheets

RUN TIME SYNTHESIZER ADAPTATION TO IMPROVE INTELLIGIBILITY OF SYNTHESIZED SPEECH

BACKGROUND OF THE INVENTION

1. Field of the Invention

The present invention generally relates to speech synthesis. More particularly, the present invention relates to a method and system for improving the intelligibility of synthesized speech at run-time based on real-time data.

2. Discussion

In many environments such as automotive cabins, aircraft cabins and cockpits, and home and office, systems have been developed to improve the intelligibility of audible sound presented to a listener. For example, recent efforts to improve the output of automotive audio systems have resulted in equalizers that can either manually or automatically adjust the spectral output of the audio system. While this has traditionally been done in response to the manipulation of various controls by the listener, more recent efforts have involved audio sampling of the listener's environment. The audio system equalization approach typically requires a significant amount of knowledge regarding the expected environment in which the system will be employed. Thus, this type of adaptation is limited to the audio system output and is, in the case of a car, typically fixed to a particular make and model of the car.

In fact, the phonetic spelling alphabet (i.e., alpha, bravo, Charlie, . . . ) has been used for many years in air-traffic and military-style communications to disambiguate spelled letters under severe conditions. This approach is therefore also based on the underlying theory that certain sounds are inherently more intelligible than others in the presence of channel and/or background noise.

Another example of intelligibility improvement involves signal processing within cellular phones in order to reduce audible distortion caused by transmission errors in uplink/downlink channels or in the basestation network. It is important to note that this approach is concerned with channel (or convolutional) noise and fails to take into account the background (or additive) noise present in the listener's environment. Yet another example is the conventional echo cancellation system commonly used in teleconferencing.

It is also important to note that all of the above techniques fail to provide a mechanism for modifying synthesized speech at run-time. This is critical since speech synthesis is rapidly growing in popularity due to recent strides made in improving the output of speech synthesizers. Notwithstanding these recent achievements, a number of difficulties remain with regard to speech synthesis. In fact, one particular difficulty is that all conventional speech synthesizers require prior knowledge of the anticipated environment in order to set the various control parameter values at the time of design. It is easy to understand that such an approach is extremely inflexible and limits a given speech synthesizer to a relatively narrow set of environments in which the synthesizer can be used optimally. It is therefore desirable to provide a method and system for modifying synthesized speech based on real-time data such that the intelligibility of the speech increases.

The above and other objectives are provided by a method for modifying synthesized speech in accordance with the present invention. The method includes the step of generating synthesized speech based on textual input and a plurality of run-time control parameter values. Real-time data is generated based on an input signal, where the input signal characterizes an intelligibility of the speech with regard to a listener. The method further provides for modifying one or more of the run-time control parameter values based on the real-time data such that the intelligibility of the speech increases. Modifying the parameter values at run-time as opposed to during the design stages provides a level of adaptation unachievable through conventional approaches.

Further in accordance with the present invention, a method for modifying one or more speech synthesizer run-time control parameters is provided. The method includes the steps of receiving real-time data, and identifying relevant characteristics of synthesized speech based on the real-time data. The relevant characteristics have corresponding run-time control parameters. The method further provides for applying adjustment values to parameter values of the control parameters such that the relevant characteristics of the speech change in a desired fashion.

In another aspect of the invention, a speech synthesizer adaptation system includes a text-to-speech (TTS) synthesizer, an audio input system, and an adaptation controller. The synthesizer generates speech based on textual input and a plurality of run-time control parameter values. The audio input system generates real-time data based on various types of background noise contained in an environment in which the speech is reproduced. The adaptation controller is operatively coupled to the synthesizer and the audio input system. The adaptation controller modifies one or more of the run-time control parameter values based on the real-time data such that interference between the background noise and the speech is reduced.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute part of this specification. The drawings illustrate various features and embodiments of the invention, and together with the description serve to explain the principles and operation of the invention.

BRIEF DESCRIPTION OF THE DRAWINGS

The various advantages of the present invention will become apparent to one skilled in the art by reading the following specification and sub-joined claims and by referencing the following drawings, in which:

DETAILED DESCRIPTION OF THE PREFERRED EMBODIMENTS

Figure 1:
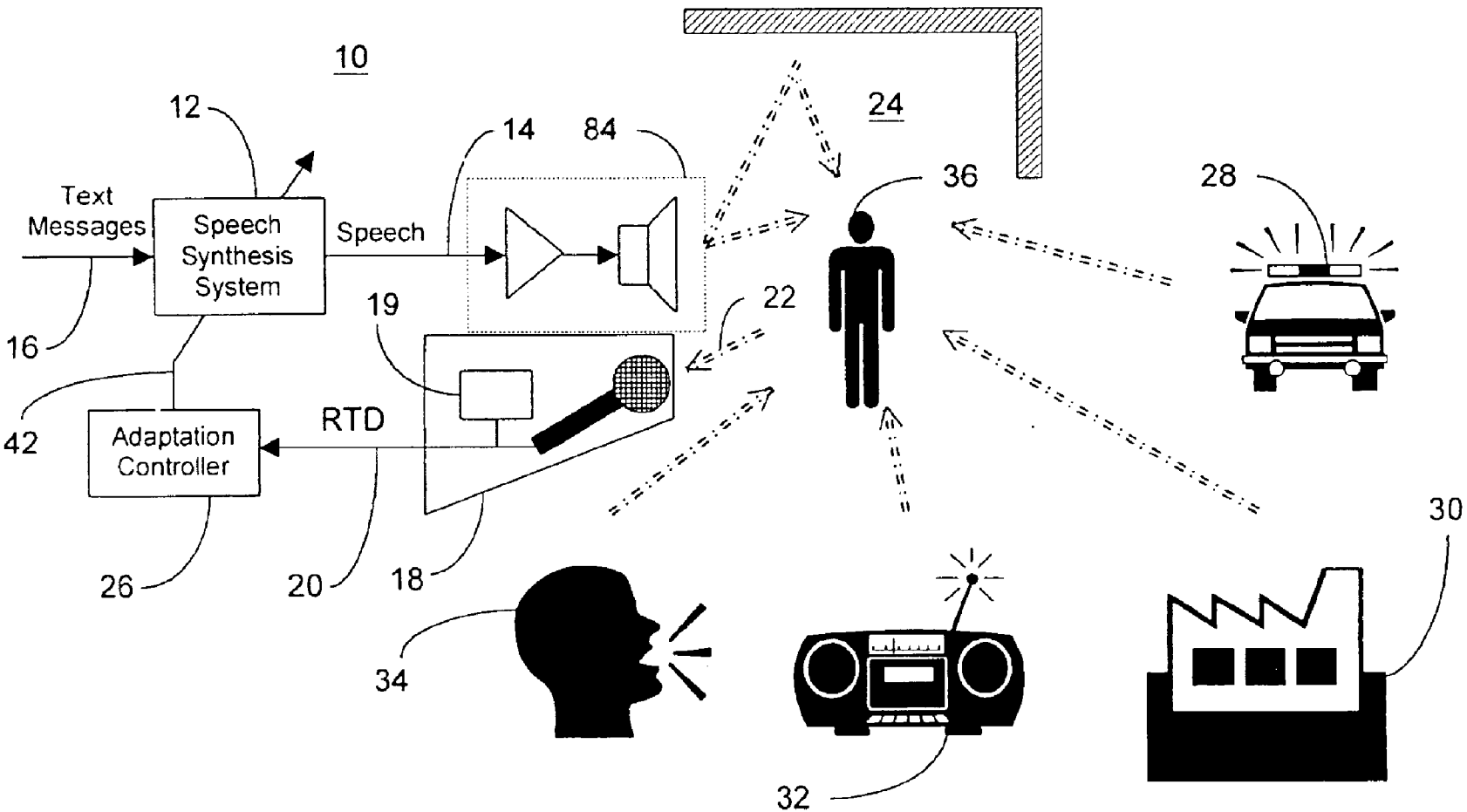
FIG. 1 is a block diagram of a speech synthesizer adaptation system in accordance with the principles of the present invention.

Turning now to FIG. 1, a preferred speech synthesizer adaptation system 10 is shown. Generally, the adaptation system 10 has a text-to-speech (TTS) synthesizer 12 for generating synthesized speech 14 based on textual input 16 and a plurality of run-time control parameter values 42. An audio input system 18 generates real-time data (RTD) 20 based on background noise 22 contained in an environment 24 in which the speech 14 is reproduced. An adaptation controller 26 is operatively coupled to the synthesizer 12 and the audio input system 18. The adaptation controller 26 modifies one or more of the run-time control parameter values 42 based on the real-time data 20 such that interference between the background noise 22 and the speech 14 is reduced. It is preferred that the audio input system 18 includes an acoustic-to-electric signal converter such as a microphone for converting sound waves into an electric signal.

The background noise 22 can include components from a number of sources as illustrated. The interference sources are classified depending on the type and characteristics of the source. For example, some sources such as a police car siren 28 and passing aircraft (not shown) produce momentary high level interference often of rapidly changing characteristics. Other sources such as operating machinery 30 and air-conditioning units (not shown) typically produce continuous low level stationery background noise. Yet, other sources such as a radio 32 and various entertainment units (not shown) often produce ongoing interference such as music and singing with characteristics similar to the synthesized speech 14. Furthermore, competing speakers 34 present in the environment 24 can be a source of interference having attributes practically identical to those of the synthesized speech 14. In addition, the environment 24 itself can affect the output of the synthesized speech 14. The environment 24, and therefore also its effect, can change dynamically in time.

It is important to note that although the illustrated adaptation system 10 generates the real-time data 20 based on background noise 22 contained in the environment 24 in which the speech 14 is reproduced, the invention is not so limited. For example, as will be described in greater detail below, the real-time data 20 may also be generated based on input from a listener 36 via input device 19.

Figure 2:
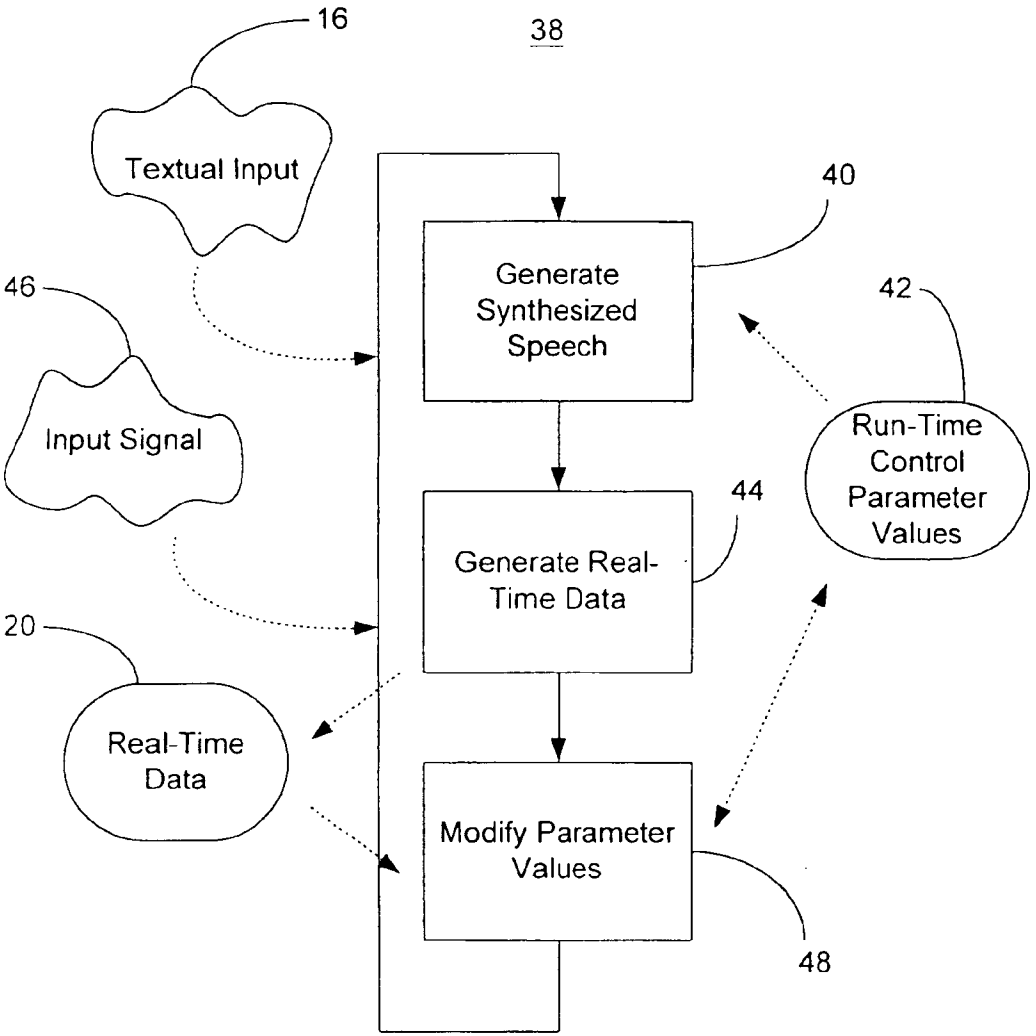
FIG. 2 is a flowchart of a method for modifying synthesized speech in accordance with the principles of the present invention.

Turning now to FIG. 2, a method 38 is shown for modifying synthesized speech. It can be seen that at step 40, synthesized speech is generated based on textual input 16 and a plurality of run-time control parameter values 42. Real-time data 20 is generated at step 44 based on an input signal 46, where the input signal 46 characterizes an intelligibility of the speech with regard to a listener. As already mentioned, the input signal 46 can originate directly from the background noise in the environment, or from a listener (or other user). Nevertheless, the input signal 46 contains data regarding the intelligibility of the speech and therefore represents a valuable source of information for adapting the speech at run-time. At step 48, one or more of the run-time control parameter values 42 are modified based on the real-time data 20 such that the intelligibility of the speech increases.

Figure 3:
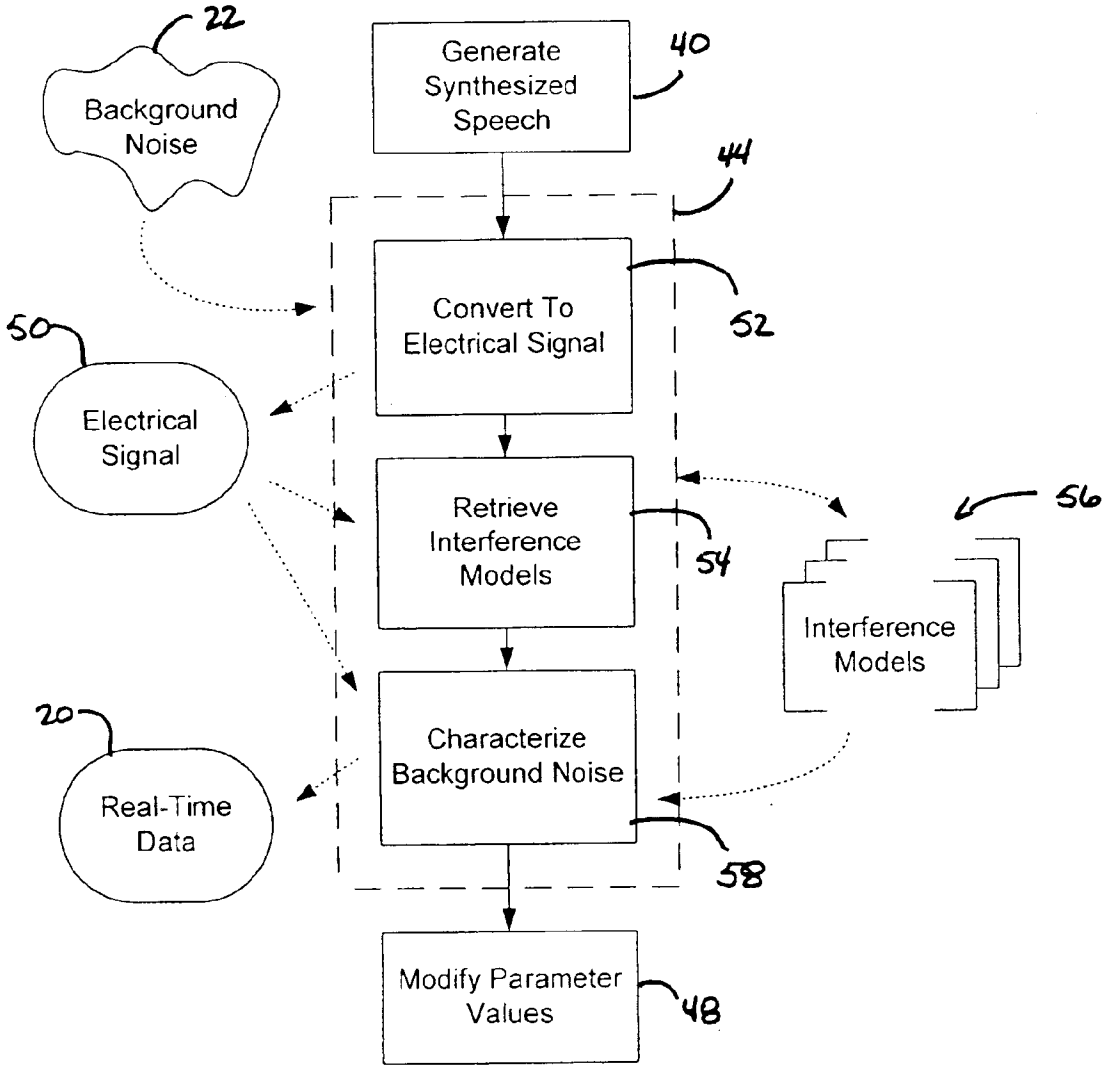
FIG. 3 is a flowchart of a process for generating real-time data based on an input signal according to one embodiment of the present invention.

As already discussed, one embodiment involves generating the real-time data 20 based on background noise contained in an environment in which the speech is reproduced. Thus, FIG. 3 illustrates a preferred approach to generating the real-time data 20 at step 44. Specifically, it can be seen that the background noise 22 is converted into an electrical signal 50 at step 52. At step 54, one or more interference models 56 are retrieved from a model database (not shown). Thus, the background noise 22 can be characterized with the real-time data 20 at step 58 based on the electrical signal 50 and the interference models 56.

Figure 4:
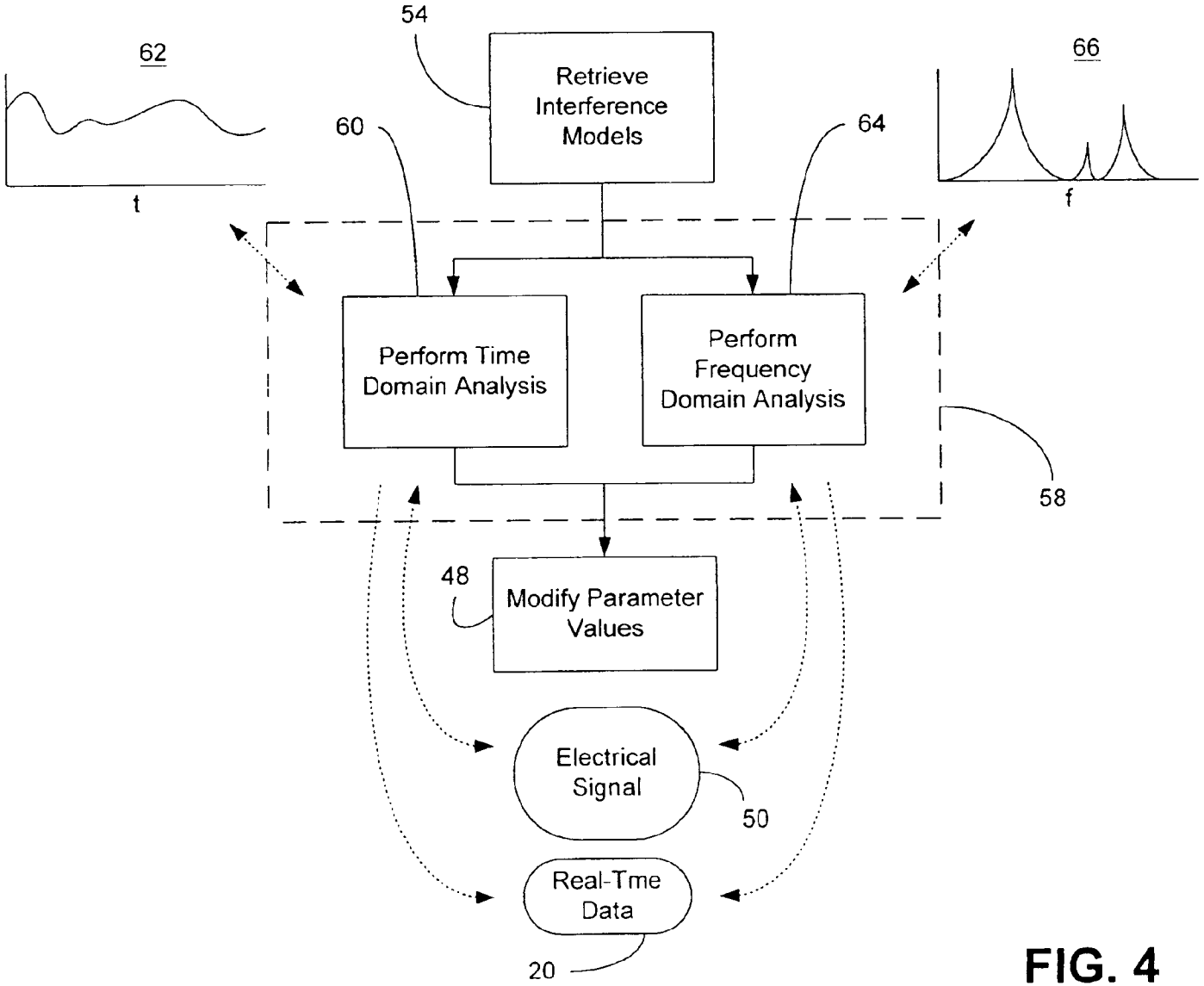
FIG. 4 is a flowchart of a process for characterizing background noise with real-time data in accordance with one embodiment of the present invention.

FIG. 4 demonstrates the preferred approach to characterizing the background noise at step 58. Specifically, it can be seen that at step 60, a time domain analysis is performed on the electrical signal 50. The resulting time data 62 provides a great deal of information to be used in operations described herein. Similarly, at step 64, a frequency domain analysis is performed on the electrical signal 50 to obtain frequency data 66. It is important to note that the order in which steps 60 and 64 are executed is not critical to the overall result.

It is also important to note that the characterizing step 58 involves identifying various types of interference in the background noise. These examples include, but are not limited to, high level interference, low level interference, momentary interference, continuous interference, varying interference, and stationary interference. The characterizing step 58 may also involve identifying potential sources of the background noise, identifying speech in the background noise, and determining the locations of all these sources.

Figure 5:
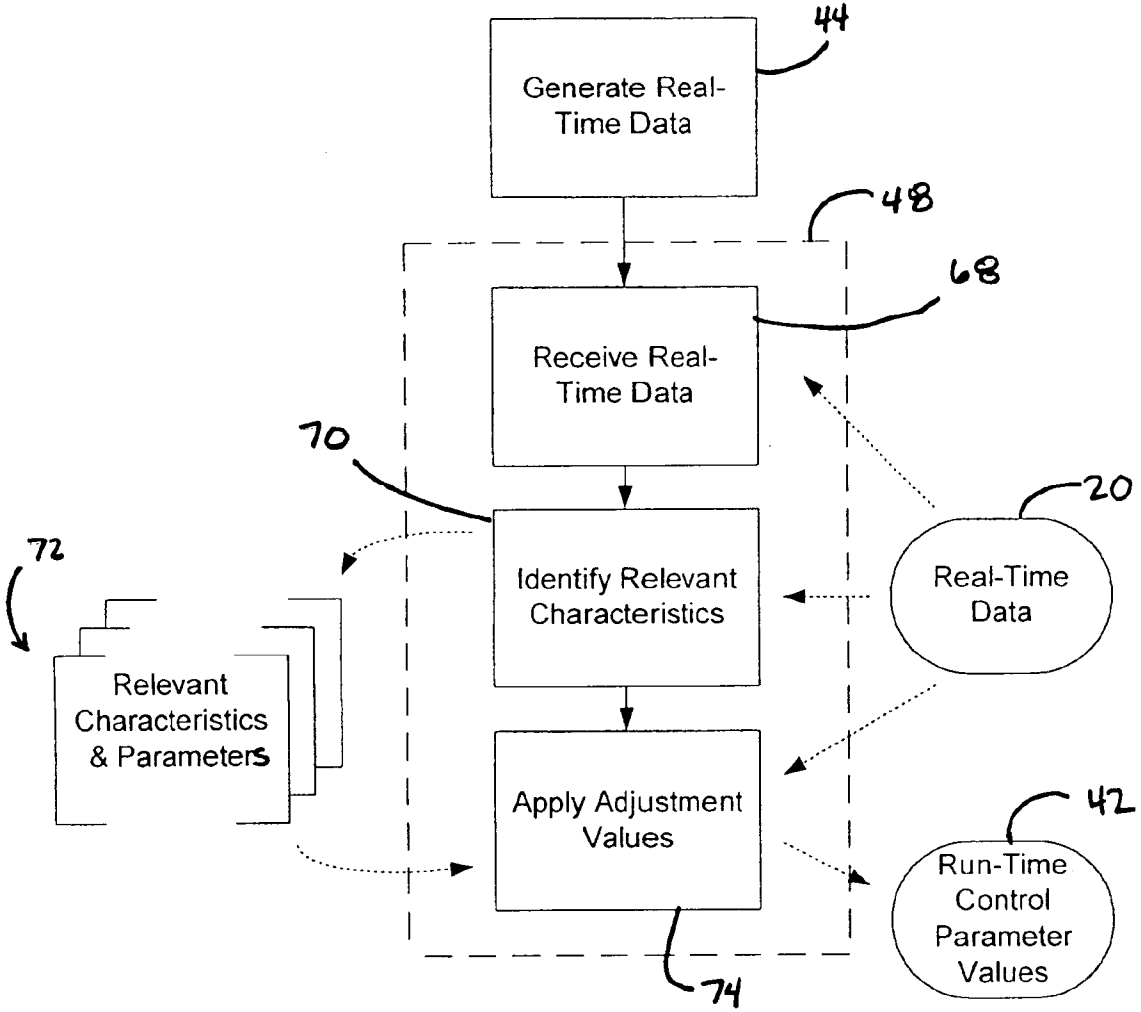
FIG. 5 is a flowchart of a process for modifying one or more run-time control parameter values in accordance with one embodiment of the present invention.

Turning now to FIG. 5, the preferred approach to modifying the run-time control parameter values 42 is shown in greater detail. Specifically, it can be seen that at step 68 the real-time data 20 is received, and at step 70 relevant characteristics 72 of the speech are identified based on the real-time data 20. The relevant characteristics 72 have corresponding run-time control parameters. At step 74 adjustment values are applied to parameter values of the control parameters such that the relevant characteristics 72 of the speech change in a desired fashion.

Figure 6:
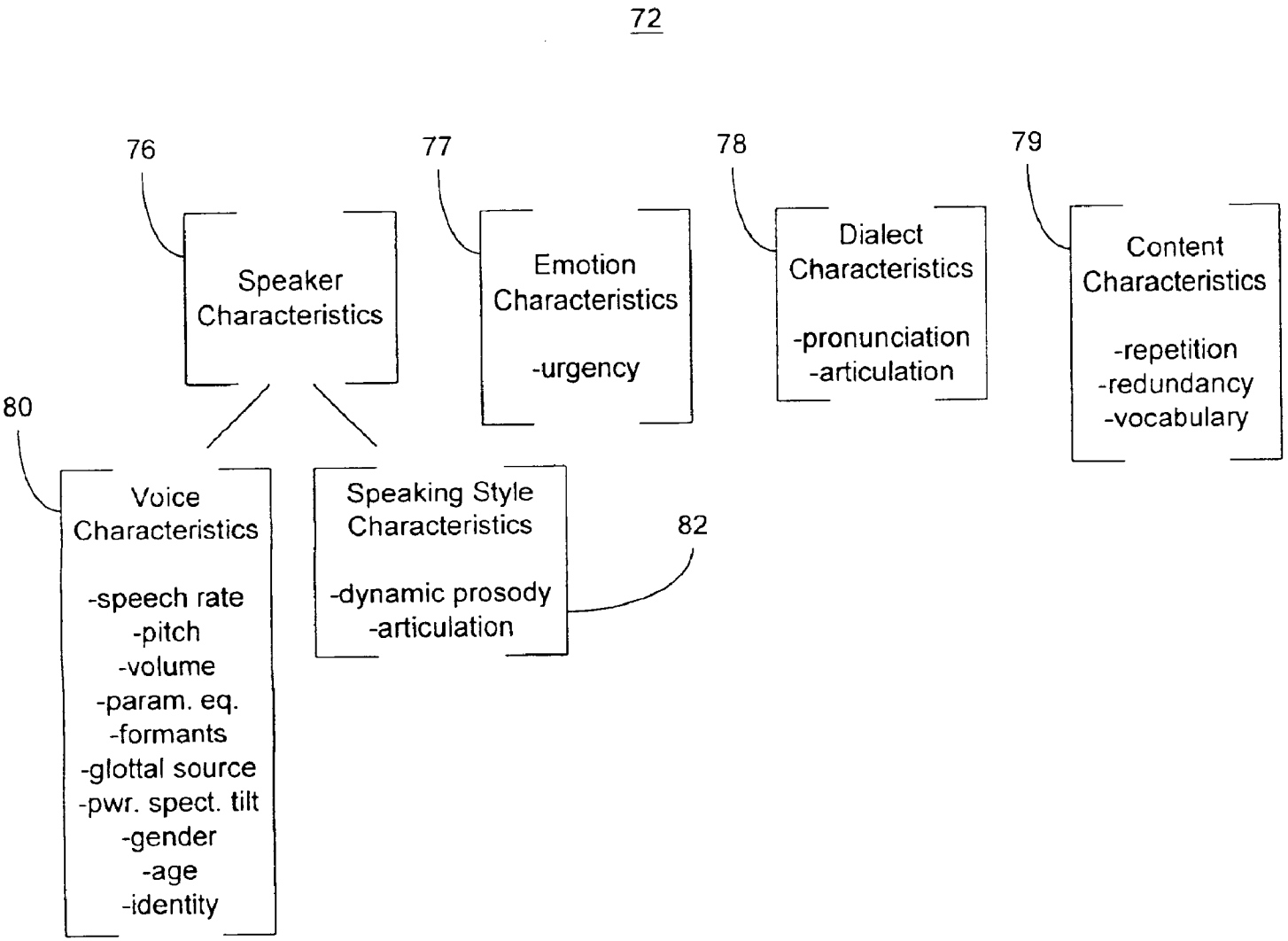
FIG. 6 is a diagram illustrating relevant characteristics and corresponding run-time control parameters according to one embodiment of the present invention.

Turning now to FIG. 6, potential relevant characteristics 72 are shown in greater detail. Generally, the relevant characteristics 72 can be classified into speaker characteristics 76, emotion characteristics 77, dialect characteristics 78, and content characteristics 79. The speaker characteristics 76 can be further classified into voice characteristics 80 and speaking style characteristics 82. Parameters affecting voice characteristics 80 include, but are not limited to, speech rate, pitch (fundamental frequency), volume, parametric equalization, formants (formant frequencies and bandwidths), glottal source, tilt of the speech power spectrum, gender, age and identity. Parameters affecting speaking style characteristics 82 include, but are not limited to, dynamic prosody (such as rhythm, stress and intonation), and articulation. Thus, over-articulation can be achieved by fully articulating stop consonants, etc., potentially resulting in better intelligibility.

Parameters relating to emotion characteristics 77, such as urgency, can also be used to grasp the listener's attention. Dialect characteristics 78 can be affected by pronunciation and articulation (formants, etc.). It will further be appreciated that parameters such as redundancy, repetition and vocabulary relate to content characteristics 79. For example, adding or removing redundancy in the speech by using synonym words and phrases (such as 5 PM=five pm versus five o'clock in the afternoon). Repetition involves selectively repeating portions of the synthesized speech in order to better emphasize important content. Furthermore, allowing a limited vocabulary and limited sentence structure to reduce perplexity of the language might also increase intelligibility.

Returning now to FIG. 1, it will be appreciated that polyphonic audio processing can be used in conjunction with an audio output system 84 to spatially reposition the speech 14 based on the real-time data 20.

Those skilled in the art can now appreciate from the foregoing description that the broad teachings of the present invention can be implemented in a variety of forms. Therefore, while this invention can be described in connection with particular examples thereof, the true scope of the invention should not be so limited since other modifications will become apparent to the skilled practitioner upon a study of the drawings, specification and following claims.

What is claimed:

1. A method for modifying synthesized speech, the method including the steps of:

generating synthesized speech based on textual input and a plurality of run-time control parameter values;

generating real-time data based on background noise contained in an environment in which the speech is reproduced;

converting the background noise into an electrical signal;

retrieving one or more interface models from a model database;

characterizing the background noise with the real-time data based on the electrical signal and the interface models; and, modifying one or more of the run-time control parameter values based on the real-time data such that the intelligibility of the speech increases.

2. The method of claim 1 further including the step of performing a time domain analysis on the electrical signal.

3. The method of claim 1 further including the step of performing a frequency domain analysis on the electrical signal.

4. The method of claim 1 wherein the characterizing step is selected from the group consisting essentially of the steps of:

identifying high level interference in the background noise;

identifying low level interference in the background noise;

identifying momentary interference in the background noise;

identifying continuous interference in the background noise;

identifying varying interference in the background noise;

identifying stationary interference in the background noise;

identifying spatial locations of sources of the background noise;

identifying potential sources of the background noise; and identifying speech in the background noise.

5. The method of claim 1 further including the steps of:

receiving the real-time data;

identifying relevant characteristics of the speech based on the real-time data, the relevant characteristics having corresponding run-time control parameters; and applying adjustment values to parameters values of the control parameters such that the relevant characteristics of the speech change in a desired fashion.

6. The method of claim 5 further including the step of changing relevant speaker characteristics of the speech.

7. The method of claim 6 further including the step of changing relevant voice characteristics of the speech.

8. The method of claim 7 further including the step of changing characteristics selected from the group consisting essentially of:

speech rate;

pitch;

volume;

parametric equalization;

formant frequencies and bandwidths;

glottal sources;

speech power spectrum tilt;

gender;

age; and, identity.

9. The method of claim 6 further including the step of changing relevant speaking style characteristics of the speech.

10. The method of claim 9 further including the step of changing characteristics selected from the group consisting essentially of:

dynamic prosody; and, articulation.

11. The method of claim 5 further including the step of changing relevant emotion characteristics of the speech.

12. The method of claim 11 further including the step of changing an urgency characteristic of the speech.

13. The method of claim 5 further including the step of changing relevant dialect characteristics of the speech.

14. The method of claim 13 further including the step of changing characteristics selected from the group consisting essentially of:

pronunciation; and, articulation.

15. The method of claim 5 further including the step of changing relevant content characteristics of the speech.

16. The method of claim 15 further including the step of changing characteristics selected from the group consisting essentially of:

repetition;

redundancy; and vocabulary.

17. The method of claim 1 further including the step of using polyphonic audio processing to spatially reposition the speech based on the real-time data.

18. The method of claim 1 further including step of inputting the run-time control parameter valves based on listener input.

19. The method of claim 1 further including the step of using the synthesized speech in an automotive application.

* * * * *